US006217072B1

(12) United States Patent
Gregg

(10) Patent No.: US 6,217,072 B1
(45) Date of Patent: Apr. 17, 2001

(54) SNOWBOARD POLE SYSTEM

(76) Inventor: Jeffrey G. Gregg, 1130 Coal Creek Rd., Longview, WA (US) 98632

( * ) Notice: Subject to any disclaimer, the term of this patent is extended or adjusted under 35 U.S.C. 154(b) by 0 days.

(21) Appl. No.: 09/060,870

(22) Filed: Apr. 15, 1998

(51) Int. Cl.[7] ..... A45F 5/00

(52) U.S. Cl. ..... 280/823; 224/222; 224/267; 280/814

(58) Field of Search ..... 280/823, 809, 280/814; 224/200, 265, 666, 222, 267, 922; 265/267

(56) References Cited

U.S. PATENT DOCUMENTS

| | | | | |
|---|---|---|---|---|
| 1,141,454 | * | 6/1915 | Fordice . | |
| 2,530,695 | | 11/1950 | Helmert . | |
| 4,596,405 | | 6/1986 | Jones . | |
| 4,620,722 | * | 11/1986 | Dunn | 280/814 |
| 4,674,787 | | 6/1987 | DeVera . | |
| 4,681,246 | | 7/1987 | Andersson . | |
| 4,699,415 | * | 10/1987 | Skovajsa | 294/814 |
| 4,819,845 | | 4/1989 | Byrd . | |
| 4,852,782 | | 8/1989 | Wu et al. . | |
| 4,852,931 | * | 8/1989 | Ferdi | 280/814 X |
| 4,883,290 | | 11/1989 | Landa . | |
| 4,953,892 | * | 9/1990 | Adkins | 280/814 |
| 4,966,322 | | 10/1990 | Zagorski et al. . | |
| 5,013,066 | * | 5/1991 | Adkins | 280/809 X |
| 5,056,819 | | 10/1991 | Hayes . | |
| 5,094,479 | * | 3/1992 | Shields | 280/814 |
| 5,154,506 | | 10/1992 | Leard . | |
| 5,400,937 | | 3/1995 | Rottenberg . | |
| 5,441,307 | | 8/1995 | Quintana et al. . | |
| 5,450,991 | * | 9/1995 | Neading | 280/814 X |
| 5,464,138 | * | 11/1995 | Rodriguez | 224/814 X |
| 5,478,117 | | 12/1995 | Quintana et al. . | |
| 5,605,263 | * | 2/1997 | Pursley et al. | 224/666 X |
| 5,934,531 | * | 8/1999 | Jablonic et al. | 224/267 X |
| 5,941,435 | * | 8/1999 | Munro | 224/267 |
| 5,947,353 | * | 9/1999 | Johnson | 224/267 |

FOREIGN PATENT DOCUMENTS

| | | |
|---|---|---|
| 2612-077 | 9/1988 | (FR) . |
| 2672811-A1 | 8/1992 | (FR) . |

OTHER PUBLICATIONS

*Snowboarder* Magazine, Spring 1998.
*Backpacker* Magazine, Mar. 1998.
*Transworld Snowboarding*, Magazine, Apr. 1998.

* cited by examiner

*Primary Examiner*—Michael Mar
(74) *Attorney, Agent, or Firm*—Kolisch, Hartwell, Dickinson, McCormack & Heuser

(57) ABSTRACT

A snowboard pole system that includes a collapsible pole and a body-mountable receiver therefor. The pole includes a user-grippable region and a snow-engaging region and selectively extends between a collapsed position and an extended position. The receiver is secured about a portion of the user's body, such as a non-articulating portion of a user's limb, and includes a pair of spaced-apart retainers, each adapted to selectively receive and retain the collapsed pole.

13 Claims, 4 Drawing Sheets

SNOWBOARD POLE SYSTEM

FIELD OF THE INVENTION

The invention relates generally to snowboard poles and storage devices, and more particularly to collapsible snowboard poles and body-mountable receivers therefor.

BACKGROUND AND SUMMARY OF THE INVENTION

By way of background, a snowboard is a winter sports device that includes an elongate board on which a user's feet are retained in relatively fixed positions by a pair of spaced-apart bindings. Unlike a pair of skis, which are always pointed in the direction of the user's movement and which enable the user's feet to be moved independent of each other to propel, steer or stop the user's movement, snowboards are capable of moving across snow in a variety of directions and do not enable the user to move his or her feet once mounted on the board to propel the board. Instead, snowboards rely upon being positioned on an inclined surface to generate speed. Once moving, the user steers and stops the board by leaning and twisting his or her body and legs to generate radial and angular movement of the board as it slides down the inclined surface.

The sport of snowboarding has experienced dramatic increases in popularity in recent years, and considerable advances have been made to both the boards and the bindings that secure a user's feet thereupon. Nonetheless, there are still several problems which have not been adequately addressed. The problems are primarily centered around three areas, namely, standing up from a sitting position once the snowboarder's feet are secured within the bindings, balancing on and steering the snowboard once standing, and moving on level or uphill ground. The first two areas are most commonly encountered by beginning snowboarders, while the latter problem area is a nuisance for all snowboarders.

Beginning snowboarders often find the sport terribly frustrating because of the basic fact that snowboards slide on sloped surfaces and remain stationary on level surfaces. While this seems very simplistic, beginning snowboarders spend most of their time sitting on the snow because they have not learned how to get to a standing position once both feet are mounted on the board and/or balance and steer themselves on the board once standing.

To use a snowboard, the user places the board near the top of a run. Then, from a sitting position near the edge of the run, the snowboarder straps both feet into the board's bindings. From this position, with the snowboarder's knees bent and the snowboard oriented at an angle with respect to the ground, the snowboarder has the challenge of getting into a standing position on the board. Because of his or her lack of leverage, the snowboarder cannot get to a standing position by simply putting his or her hands on the ground and pushing upwards. Therefore, one of two methods must be used. In the first, the snowboarder grabs the front end of the board and rocks forward, dropping the bottom of the board to lie against the downslope of the run. This rolling motion and the leverage provided by grabbing the tip of the board collectively pull the user to a standing position. Although difficult to master, it is the quickest conventional way to get to a standing position, provided the user has sufficient forearm and abdominal strength to perform this maneuver.

The other alternative is for the snowboarder to flip over so that he or she is kneeling toward the ground with the board extending rearwardly behind the snowboarder. From this position, it is possible for a snowboarder to push up from the ground with his or her hands and get to a standing position on the board. Although not as quick, this basic maneuver is the most commonly used method for beginning snowboarders to get to a standing position once strapped onto the board. Although this method works, it is awkward, somewhat slow and requires the snowboarder to consistently sit and put his or her hands in the snow. Therefore, there is a need for a device that the snowboarder can use to easily get from a sitting position to a standing position on the board.

Unfortunately, this only begins the beginning user's problems. If the board is on level ground, so that it does not immediately begin sliding once the user is standing, it is possible for the user to get accustomed to the feel of standing and leaning on the board. Because the board is on a level surface, however, it does not go anywhere. Therefore, the snowboarder is forced to hop to the edge of the run or sit down, remove at least one foot from its binding, move to the edge of the run and repeat the above process. If the board is on an inclined surface, the board immediately begins sliding as soon as the user's body is off the ground. This does not, however, mean that the snowboarder is fully standing or even balanced on the board. This explains why beginning snowboarders commonly fall almost immediately after standing or attempting to do so. Therefore, there is a need for a device that may be used for balance and stability while a snowboarder learns to stand and balance upon, as well as steer and otherwise maneuver, a snowboard.

Beginning and advanced snowboarders face additional delays and hassle when they need to travel over level or upwardly inclined ground. Because almost all ski areas are designed for skiers, who can easily navigate fairly large level or inclined surfaces, this problem is fairly often encountered by snowboarders. Examples of such situations are encountered at the bottom of a run when a snowboarder needs to get to the lift, and at the top of the run when the snowboarder needs to get from the lift to the start of the desired run. When only very short, relatively flat distances need to be traveled, the common, although tiring, solution is to hop to the desired position. When this solution is not practical, the snowboarder must sit down and take at least one foot out of its binding. With one foot removed, the user can propel the snowboard much like a skateboard. Unfortunately, this one-foot-on and one-foot-off position causes a significant percentage of injuries, especially to beginning snowboarders as they try to stop and steer the board.

When longer or steeper distances must be traveled, the typical, time-consuming solution is to sit down, remove both feet from their bindings, carry the snowboard to the new spot, sit down, replace both feet in their bindings, and then perform one of the above-discussing standing maneuvers. Therefore, there is a need for a device that enables a snowboarder to propel him or herself across level or uphill ground without the effort and time required by conventional methods.

The present invention overcomes these and other problems in the form of a collapsible snowboard pole and a body-conforming receiver onto which the collapsed pole is secured when not being used. The pole includes a user-grippable region and a snow-engaging region and selectively collapses and extends between a collapsed length and an extended length. The receiver is secured on a portion of a snowboarder's limb and includes a pair of spaced-apart retainers into which the collapsed pole is selectively received and retained.

These and other advantages of the present invention will be more readily understood after a consideration of the drawings and the detailed description of the preferred embodiments which follow.

DETAILED DESCRIPTION OF THE INVENTION

Figure 1:
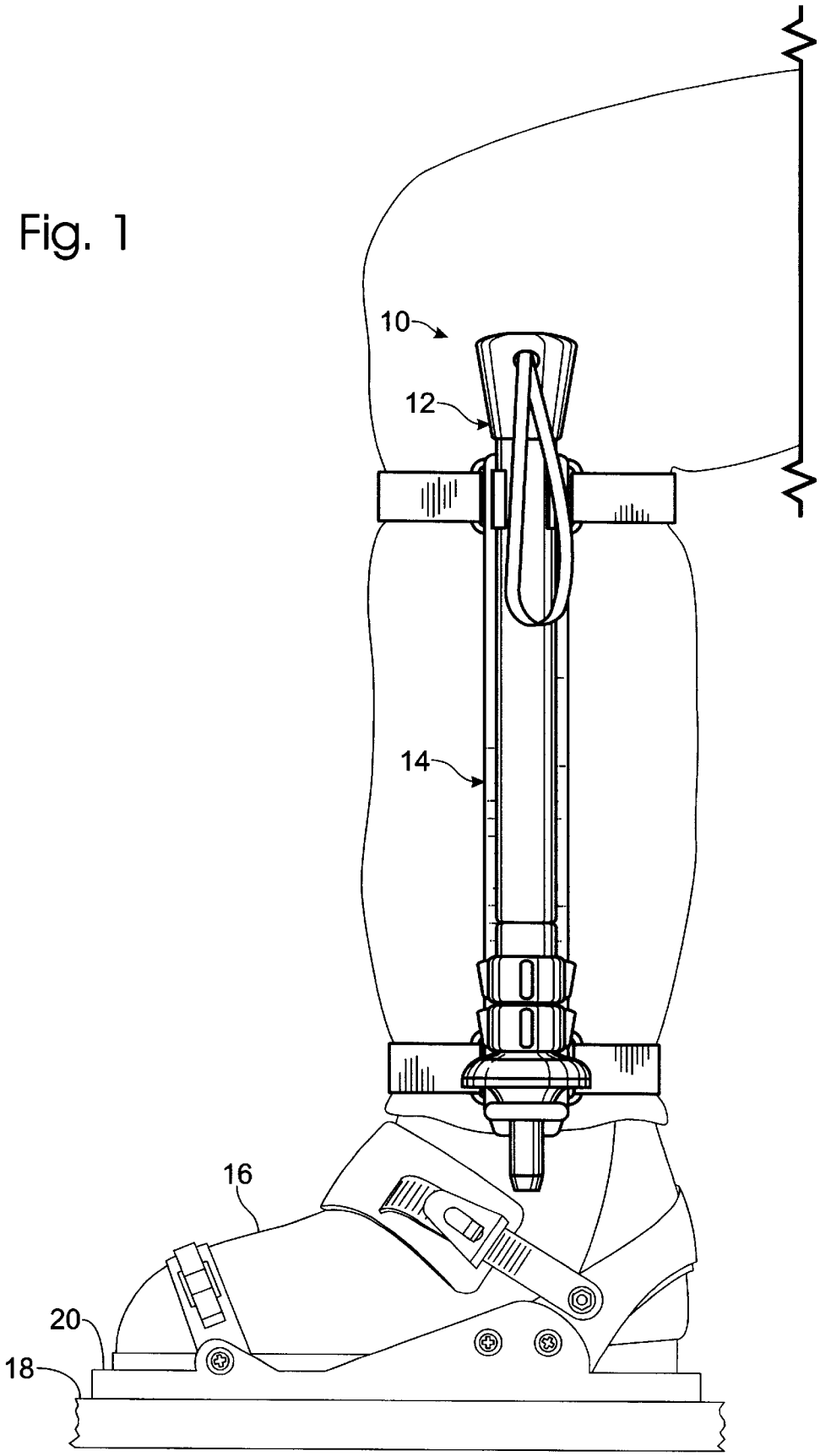
FIG. 1 is a side elevation view of the invented snowboard pole and receiver mounted on a snowboarder's lower leg.

The invented snowboard pole system is shown in FIG. 1 and generally indicated at 10. System 10 includes a collapsible snowboard pole 12 and a receiver, or body-securable harness, 14 that receives the collapsed pole and retains it near the user's body. Although only one collapsed pole and receiver are shown are FIG. 1, it should be understood that a pair of poles and receivers would most commonly be used, one mounted on each leg or other limb of the user.

In FIG. 1, system 10 is shown mounted on a user's lower leg. As shown, the user's boot 16 is mounted on a snowboard 18 by a binding 20, which is strapped about boot 16 to secure the boot (and thus the user's leg and foot) to the board in a defined orientation with respect to the board. Receiver 14 is shown mounted on the user's lower leg, where it extends generally along the leg between the user's ankle and knee. It should be understood that references made herein to the user's body or limbs include any clothing, bindings, braces, etc. between the user's actual body part and the receiver or other device mounted thereupon. Therefore, when the receiver is said to be mounted on the user's lower leg, it includes the fact that there may be clothing, binding portions, boot portions, brace portions, etc. between the user's skin and the receiver.

In FIG. 1, it can be seen that receiver 14 is strapped around the leg in two spaced-apart positions, one generally adjacent the user's ankle and the other just below the user's knee. It should be understood that other mounting positions are possible, including other positions on the user's limbs, such as on the user's thighs, forearms and upper arms. When selecting a suitable mounting position, receiver 14 must be mounted on the user's body in a position where it will not hinder the user's flexibility or movement, while also maintaining the collapsed pole 12 in a location where it can quickly and easily be reached, removed and remounted by the user. Other possible mounting positions include the user's back, chest and hips, as long as the above-requirements are met.

Because snowboard pole 12 is mounted on receiver 14 when the snowboarder is snowboarding down a run, receiver 14 should retain pole 12 in an out-of-the-way position where it will not be dislodged or otherwise struck by the user while snowboarding. Additionally, pole 12 must be retained on receiver 14 in a position, and with sufficient force, that pole 12 will not be dislodged while the snowboarder slides down the hill, including the jumps and tricks often seen performed by more advanced snowboarders.

Figure 2:
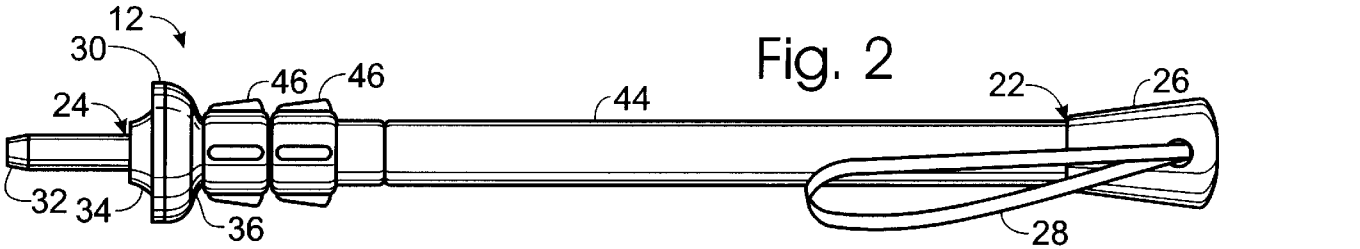
FIG. 2 is a side elevation view of the pole of FIG. 1 in a collapsed position.
Figure 3:
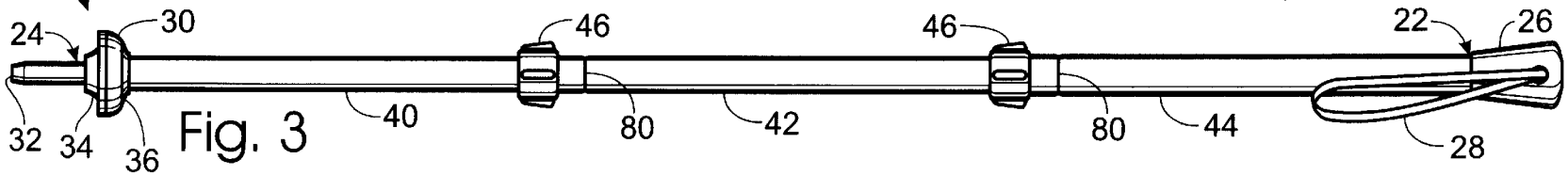
FIG. 3 is a side elevation view of the pole of FIG. 2 in an extended position.

As shown in FIGS. 2 and 3, pole 12 includes a pair of opposed end regions 22 and 24, the first of which may be referred to as a user-grippable region, which includes a user-grippable element, such as knob 26. Because the pole is mounted against the user's body, its user-grippable element will most commonly resemble a knob or small protrusion that is sized and shaped to fit within the palm of the user's hand, thereby minimizing size and fitting closely against the receiver or portion of the user's limb. Therefore, knob 26 preferably provides a gribbable surface without adding the significant size of the handles used with most ski poles. As shown, knob 26 includes a looped strap 28 through which the user's hand may be passed when the pole is used. Strap 28 couples the pole to the user's wrist in case the pole is unintentionally released by the user.

The other end region 24 may be referred to as a snow-engaging region and includes snow-engaging elements, such as basket 30 and tip 32. Snow-engaging region 24 is similar to the end of a conventional ski pole, and may include any of the features commonly associated therewith. As perhaps best seen in FIG. 2, basket 30 is retained on pole 12 by collars 34 and 36. The size and configuration of basket 30 may take the form of any conventional basket used with ski poles and may be selectively interchanged to enable the basket to be adjusted to best fit the conditions on any particular day.

As discussed, pole 12 is selectively extendable between a range of positions bounded by a collapsed position (shown in FIGS. 1 and 2) and an extended position (shown in FIG. 3). It should be understood that pole 12 may collapse and extend between these positions via any known mechanism that provides the necessary support and strength for the application described herein. The presently preferred form is for pole 12 to be comprised of a plurality of interconnected, telescoping segments 40–44, as shown in FIG. 3. The collapsed length of pole 12 should be short enough that the pole will not interfere with the user's movement or flexibility when the pole is mounted on receiver 14.

For example, when used by most adults, this length may range between approximately nine or more inches and approximately twenty-four or less inches, preferably is within the range of approximately twelve and approximately twenty-two inches, and even more preferably is within the range of approximately fifteen and approximately twenty inches. When the pole is built for use by shorter users, such as children, it should be understood that the collapsed and extended lengths of the pole will be decreased proportionately. Similarly, extremely tall users may require poles that are longer than twenty-four inches in length. Furthermore, the number of segments may also vary between two and four or more interconnected segments, however, three segments are presently preferred because they enable collapsed and extended lengths that meet the requirements described herein.

Adjacent segments are secured in user-selected positions with respect to each other by lock mechanisms 46. It should be understood that any known lock mechanism for selectively retaining segments 40–44 with respect to each other may be used. Examples of suitable lock mechanisms include various known cam structures used in collapsible ski poles, walking sticks and golf ball retrievers that are actuated by rotating adjacent, partially overlapping segments with respect to each other. Other suitable lock mechanisms may include mechanisms used with tripods or other stands that are engaged by manipulation of a latch mounted at one end of the pole, or mechanisms used with crutches and other supports that include one or more detents and/or pushbutton mechanisms that selectively prevent the adjacent members from collapsing once extended beyond a defined location. Other suitable lock mechanisms are disclosed in U.S. Pat. Nos. 5,478,117 and 5,441,307 to Quintana et al., and U.S. Pat. No. 4,596,405 to Jones, the disclosures of which are hereby incorporated by reference. Still others are manufactured by Testrite of Newark, N.J.

When selecting a suitable lock mechanism, the mechanism must be able to selectively secure adjacent segments together even when the user's full weight is placed upon the pole. Unlike a ski pole, the invented snowboard pole is used to provide leverage and support to the user as the user rises from a sitting position to an upright position on the board. Therefore, the lock mechanism must be able to support this weight, which often times is several hundred pounds. An additional factor is that the lock mechanism should be actuable without requiring precise manipulation of the mechanism. Because the user will most commonly be wearing gloves or mittens, the user needs to be able to selectively engage and release the mechanism without removing his or her gloves or mittens. Additionally, because of the cold environment in which snowboards are typically used, the user's fingers often have less than their normal dexterity and nimbleness.

Figure 4:
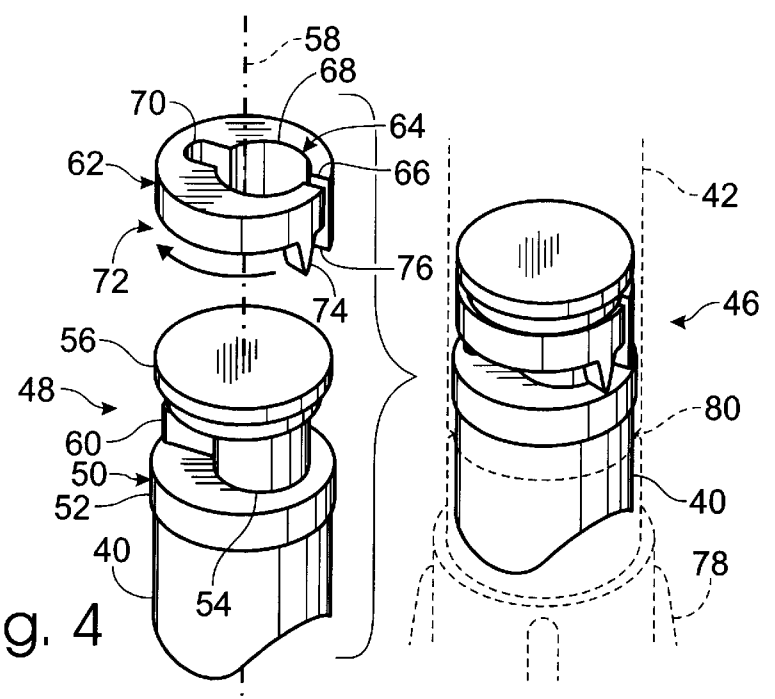
FIG. 4 is a detail of the lock mechanism that secures adjacent lengths of the pole of FIG. 2, with the lock mechanism in an unlocked position.
Figure 5:
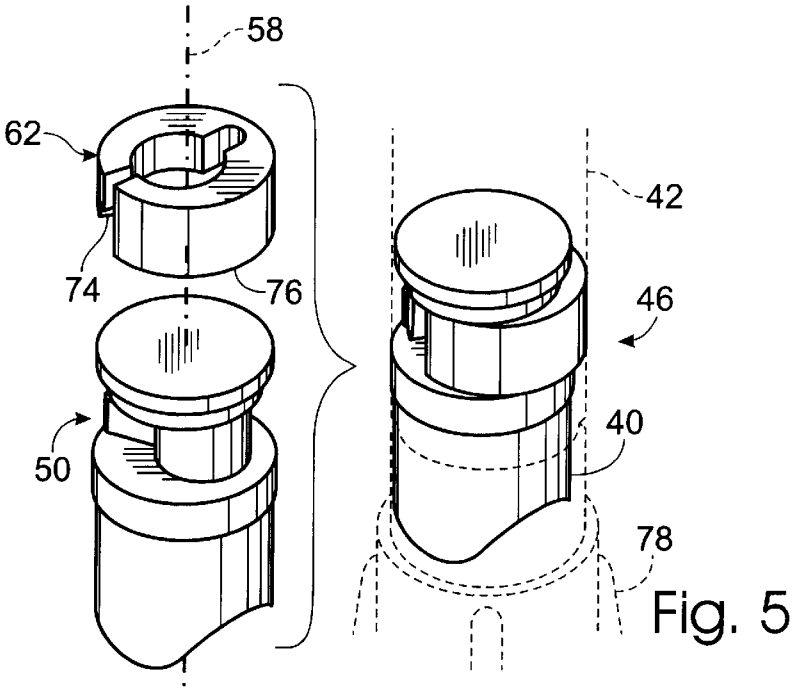
FIG. 5 is a detail of the lock mechanism of FIG. 4, with the lock mechanism in a locked position.

A suitable lock mechanism 46, shown for an illustrative and non-exclusive example, is shown in FIGS. 4 and 5. Mechanism 46 is shown interconnecting segments 40 and 42, which telescope and partially overlap with each other. Mechanism 46 includes a cam structure 48 that selectively locks and releases the adjacent segments as the segments are rotated with respect to each other.

In FIG. 4, it can be seen that cam structure 48 includes an axial member 50, which is mounted on the end of the smaller diameter segment, namely segment 40. Member 50 includes a base 52, a shaft 54 of smaller diameter than segment 40, and a top 56. As shown, shaft 54 extends between base 52 and top 56 and is offset from the longitudinal axis of segment 40, which is generally indicated at 58 in FIGS. 4 and 5. Member 50 further includes a tab 60, which extends away from shaft 54 generally transverse to axis 58.

Cam structure 48 further includes a collar 62, which is mounted upon and rotatable about shaft 54. Collar 62 has a generally cylindrical configuration and includes an aperture 64, which is sized to enable the collar to be rotatably mounted about shaft 54. Aperture 64 extends from the perimeter of collar 62 to define a neck region 66, which retains the collar about shaft 54. Extending from neck region 66, aperture 64 includes a central passage 68 with a diameter generally corresponding to that of shaft 54. Finally, aperture 64 terminates with a removed region 70 that extends proximate the perimeter of collar 62 opposite neck region 66 to enable collar 62 to more easily deform to mount collar 62 on shaft 54.

Figures 6, 7, 8:
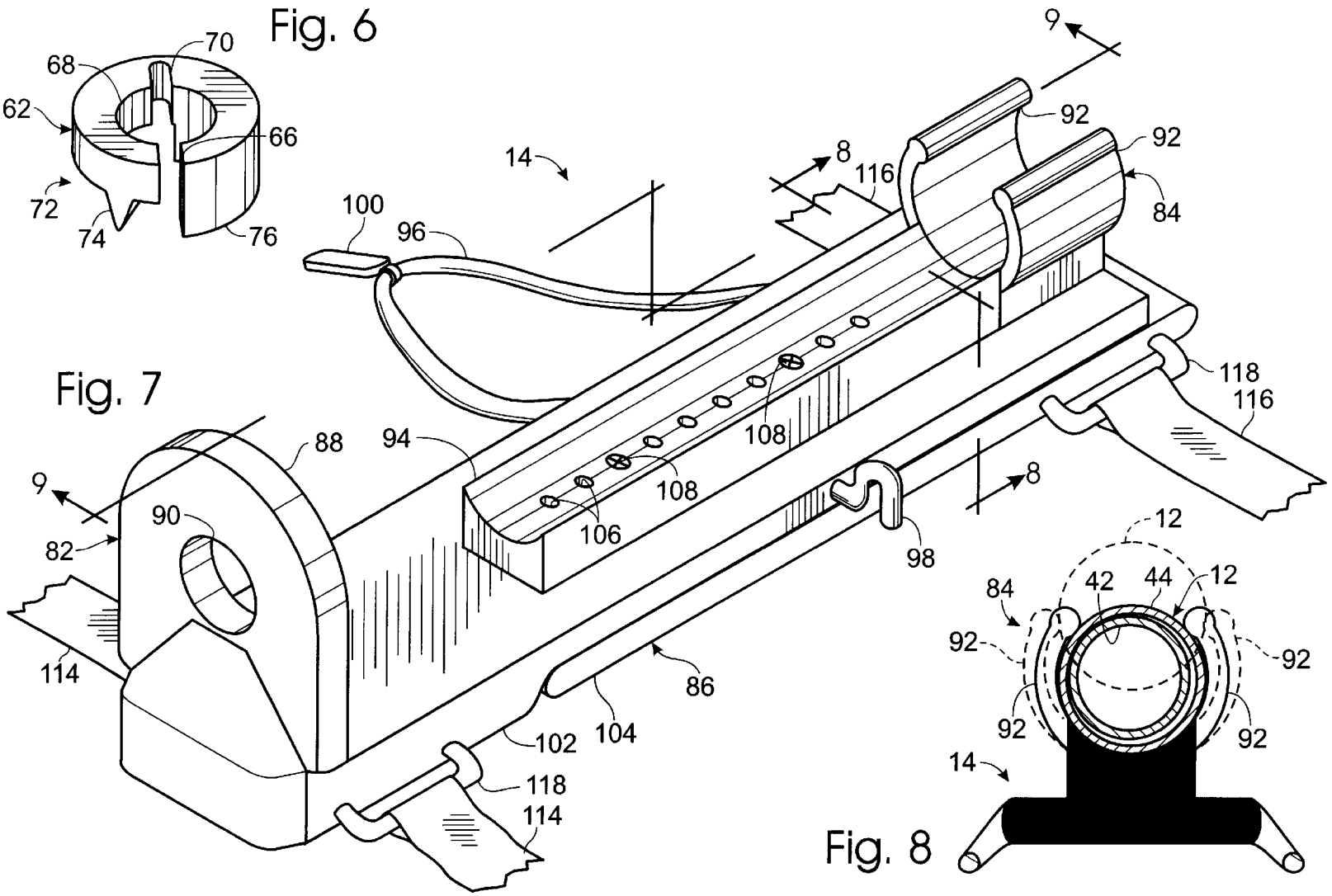
FIG. 6 is an isometric view of a portion of the lock mechanism of FIG. 4.
FIG. 7 is an isometric view of the receiver of FIG. 1 with an attached pole-receiving strap.
FIG. 8 is a cross-sectional view of the receiver of FIG. 1 taken along the line 8—8 in FIG. 7 with the pole engaged by one of the receiver's retainers.

As further shown in FIGS. 4 and 6, collar 62 defines a track 72 bounded by radially spaced-apart stops, namely a tooth 74, adjacent one side of neck region 66, and a support 76 that extends from the other side of neck region 66. When collar 62 is rotated about shaft 54, tab 60 travels within track 72. When tab 60 engages either of stops 74 and 76, collar 62 is prevented from rotating about shaft 54, and the adjacent segments are either locked in a selected length or free to be telescoped with respect to each other to a shorter or longer length. As shown, central passage 68 of aperture 64 is offset from the center of collar 62 to substantially the same extent that shaft 54 is offset from the center of base 52. In FIG. 4, collar 62 is shown in a first position in which collar 62 and base 52 are at least substantially superimposable along the axis of the smaller diameter segment and collectively have a maximum diameter that is less than the inner diameter of the overlapping, larger diameter of segment 42. From the first position, collar 62 is rotatable to and from a second position (shown in FIG. 5), in which collar 62 is rotated from the first position so that it protrudes beyond the perimeter of base 52 to give base 52 and collar 52 a collective maximum diameter that is as large as the inner diameter of segment 42 and therefore wedges, or frictionally retains, the segments at their selected combined length.

In FIG. 4, lock mechanism 46 is shown in its unlocked, or unbiased, position, in which the collective length of the joined segments (in this case segments 40 and 42) is adjustable simply by extending or shortening the degree to which the segments telescope with respect to each other. As shown, tab 60 abuts the portion of support 76 distal neck region 66, and collar 62 is in its first position, where it is substantially superimposable with base 52. Once a desired length is selected, the segments are rotated about their long axes so that tab 60 travels to the other end of track 72, as shown in FIG. 5. In this position, tab 60 abuts tooth 74 and the segments are frictionally locked in the selected position by the force of collar 62 and base 52 against the inner wall of segment 42.

It should be understood that the lock mechanism 36 connecting segments 42 and 44 operates in the same fashion described above and contains the same elements and sub-elements. Furthermore, to enable the user to get a better grip on the segments, the ends of segments 44 and 42 facing tip 32 include a grip 78.

Preferably, segments 40–44 are prevented from becoming unintentionally detached from each other, such as if a user pulls one segment too far out of the overlapping segment. To prevent this, a portion of segments 42 and 44 proximate tip 34 include a neck region 80 of smaller diameter than the rest of the corresponding segment, and a portion of segments 40 and 42 distal tip 34 and neck region 80 include a region of larger diameter than neck region 80. As shown for example in FIG. 4, neck region 80 of segment 42 is shown in dashed lines and is of smaller diameter than the rest of segment 42, while base 52 has a larger diameter than neck region 80 and is housed within segment 42 on the opposite side of neck region 80 than tip 32. In this configuration, base 52 acts as a stopper or plug that prevents segment 40 from being fully withdrawn out of segment 42. It should be understood that the relative spacing of neck region 80 on segment 42 and 44 may vary, but it preferably is relatively near the end of the corresponding segment that faces tip 32. The farther neck region 80 is away from this end, the less the length of pole 12 can be extended. Furthermore, the smaller diameter segment may include a rib or protruding portion other than base 52.

Turning now to FIG. 7, receiver 14 can be seen in more detail. Receiver 14 is a pole-receiving structure that is sized to receive and retain pole 12 when the pole is in its collapsed position. Receiver 14 includes a pair of spaced-apart retainers 82 and 84, which are each configured to selectively engage a portion of the collapsed pole and prevent it from being unintentionally removed from receiver 14. Retainers 82 and 84 are generally aligned along the long axis of receiver 14, along which pole 12 is mounted and supported. The retainers are supported in this position by an elongate support structure, or support, 86, which extends therebetween. As shown, retainers 82 and 84 extend from the opposed end regions of receiver 14, although it is within the scope of the present invention that the retainers may be mounted closer together or are adjustably mounted on the receiver.

Figure 9:
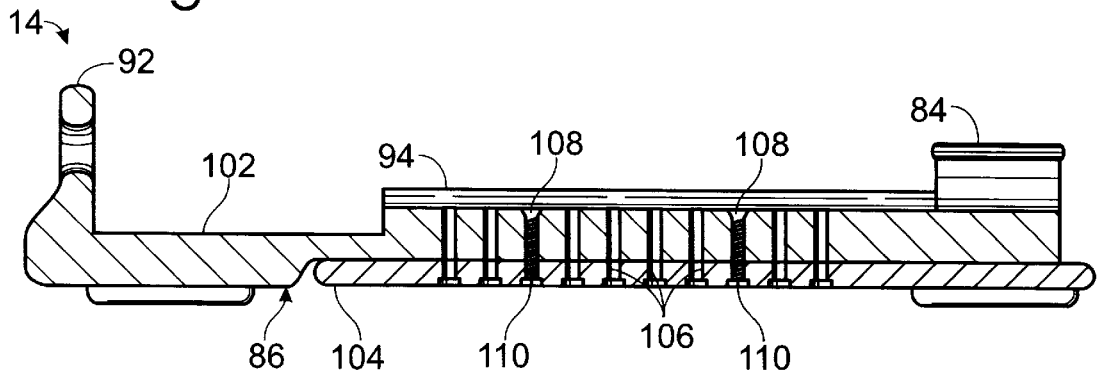
FIG. 9 is a side sectional view of the receiver of FIG. 7 taken along the line 9—9 in FIG. 7.

Retainer 82 extends generally transverse to the long axis of receiver 14 and includes a projecting shelf or ledge 88 with an aperture 90 through which tip 32 of pole 12 is passed when the collapsed pole is mounted on the receiver. As perhaps best seen in FIGS. 7 and 9, retainer 82 and support 86 collectively form a generally L-shaped carrier for pole 12. When tip 32 is passed through aperture 90, pole 12 is essentially seated upon the ledge 88 because basket 30 cannot pass through aperture 90. Retainer 82 could also be described as forming a closed, relatively rigid loop with a central passage, namely aperture 90, extending transverse to the long axis of receiver 14. It should be understood that the size and configuration of aperture 90 may vary, however, it should be small enough to prevent basket 30 and/or collar 34 from passing therethrough, while still being large enough to permit tip 32 to be easily inserted therein. If aperture 90 is too small, it will require the user to very carefully position tip 32 in order to insert it within aperture 90.

Retainer 84 is adapted to receive a portion of collapsed pole 12 generally adjacent knob 26, namely a portion of the largest diameter segment, which as shown is segment 44. Retainer 84 includes at least one deformable member, or clip, 92 that deforms outwardly from a rest position (shown in FIG. 7 and in solid lines in FIG. 8) to a biased position (shown in dashed lines in FIG. 8) as pole 12 is inserted into or removed from engagement with retainer 84 and thereafter returns at least substantially to the rest position. As such, retainer 84 enables pole 12 to be snap-fit into and out of engagement with receiver 14.

Returning to FIG. 7, it can be seen that support structure 86 includes a region 94 with a concave cross-sectional configuration measured along the long axis of receiver 14. Preferably, region 94 has an axis of curvature that is substantially similar to the axis of curvature of largest diameter segment 44 so that it cradles or at least partially extends around segment 44 when pole 12 is mounted on receiver 14. This relatively broad region of contact between pole 12 and region 94 stabilizes and supports pole 12 when mounted on receiver 14.

As shown, region 94 extends from retainer 84 toward retainer 82, but does not extend the full distance therebetween. This is because basket 30 has a larger diameter than segment 44, and therefore would interfere with pole 12 being both inserted at least partially within aperture 90 and also being snap-fit into retainer 84 and supported along region 94.

To further secure collapsed pole 12 upon receiver 14, receiver 14 includes a pole-retaining strap 96 that extends from one side of receiver 14, and a clasp or hook 98 on the other side. Preferably strap 96 is elastomeric and includes a handle portion 100 that enables strap 96 to be more easily gripped and positioned by the user, even when wearing gloves or mittens. Strap 96 is sized to be drawn from where it is mounted on one side of receiver 14, around the portion of the collapsed pole distal support structure 96 and thereafter retained on the other end of support structure 86 by clasp 98. As such, strap 96 and support structure 86 define a closed boundary around pole 12 in a direction transverse to the long axis of the mounted pole. Strap 96 prevents pole 12 from being unintentionally dislodged from receiver 14 under any condition.

It should be understood that the above-described retainers 82 and 84 should prevent unintentional removal of pole 12 from receiver 14 under substantially all conditions, however, strap 96 is provided for an added degree of security when the user is performing expert tricks, or when the user is not going to use the pole for a while. It should be further understood that the pole-retaining strap may include the looped structure shown in FIG. 8, only a single length of strap (which is secured to the clasp once extended around the portion of the pole), or a pair of strap segments, one on each side of the support structure and adapted to be secured together by any suitable fastening mechanism.

As shown in FIG. 7, support structure 86 is formed from first and second 102 and 104 generally planar members that are slidably adjustable with respect to each other to adjust the end-to-end length of receiver 14. Perhaps best seen in FIG. 9, support structure 86 includes a plurality of spaced-apart sockets 106 extending through members 102 and 104 and generally aligned in a spaced-apart relationship between retainers 82 and 84. Members 102 and 104 are secured in a selected position with respect to each other by any suitable fastening mechanism. For example, in FIGS. 7 and 9 a pair of screws or bolts 108 are passed through selected sockets 106 and retained therein by nuts 110 or other suitable devices. Alternatively, sockets 106 may be threaded so that a screw can be inserted and retained therein without requiring a nut or similar device. As shown, both retainers 82 and 84 are mounted on the same member of support structure 86, however, it is within the scope of the present invention that one retainer could be mounted on each member so that the distance between the retainers could be adjusted when the length of the receiver is adjusted.

As discussed above, retainer 14 is mounted on a portion of a user's limb. Preferably, this is a non-articulating portion (meaning between adjacent joints) so that the receiver and collapsed pole will not restrict or otherwise interfere with the user's flexibility and mobility. To secure receiver 14 to a selected limb portion, the invented snowboard pole system 10 includes strap structure 112 that extend around the user's limb to secure receiver 14 thereupon, with the long axis of support structure 86 extending generally parallel to the long axis of the limb portion. As shown in FIG. 7, the strap structure includes a pair of spaced-apart straps 114 and 116, each extending from mounts 118 on a respective one of members 102 and 104. Each strap 114 and 116 includes one or more segments that collectively extend around the portion of the user's limb. It should be understood that it is within the scope of the present invention that straps 114 and 116 may be of fixed or adjustable length and may be formed from a flexible and/or elastic material. Furthermore, when the strap includes more than one segment, it may further include any suitable fastening mechanism, such as a hook and loop closure mechanism, a buckle, a snap, etc. to join the segments together to complete the closed loop around the limb portion.

Figure 10:
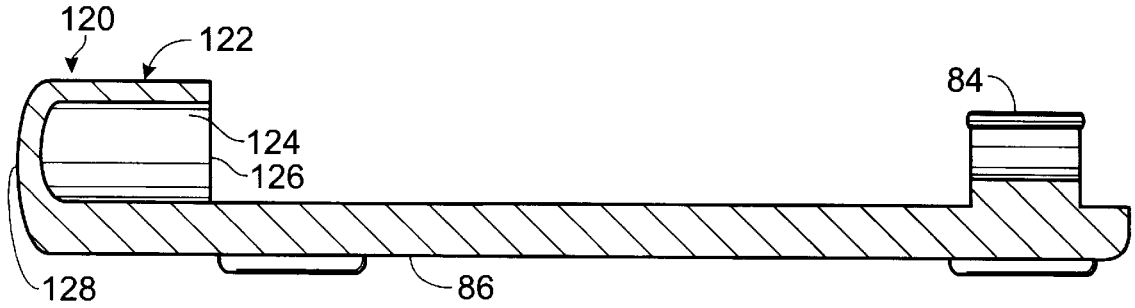
FIG. 10 is a side elevation view showing another embodiment of the invented receiver.

Another embodiment of the invented receiver is shown in FIG. 10 and indicated generally at 120. Receiver 120 is similar to the above-described receiver 14, except that its support structure 86 is not adjustable in length. Instead, it is formed from a single member, with corresponding retainers mounted proximate each end thereof. Furthermore, as shown, instead of the previously described retainer 82, receiver 120 includes a cup-shaped retainer 122 that defines a cavity 124 into which tip 32 is inserted when pole 12 is mounted on the receiver. Retainer 122 has an open end 126 that should be sized similar to the above-described considerations with respect to aperture 90, and a closed bottom portion 128 that prevents pole 12 from being pushed in the direction of retainer 84 if tip 32 is struck or otherwise impacted while pole 12 is mounted on the receiver. Also, receiver 120 does not include concave region 94.

It is meant to be within the scope of the present invention that any of these elements (a fixed length receiver, a cup-shaped retainer, and no concave stabilizing region) may be selectively interchanged with the other elements of the invented receivers described herein. For example, receiver 14 may be formed with cup-shaped retainer 122 instead of retainer 82 or with a planar support 86 that does not include concave region 94.

Figure 11:
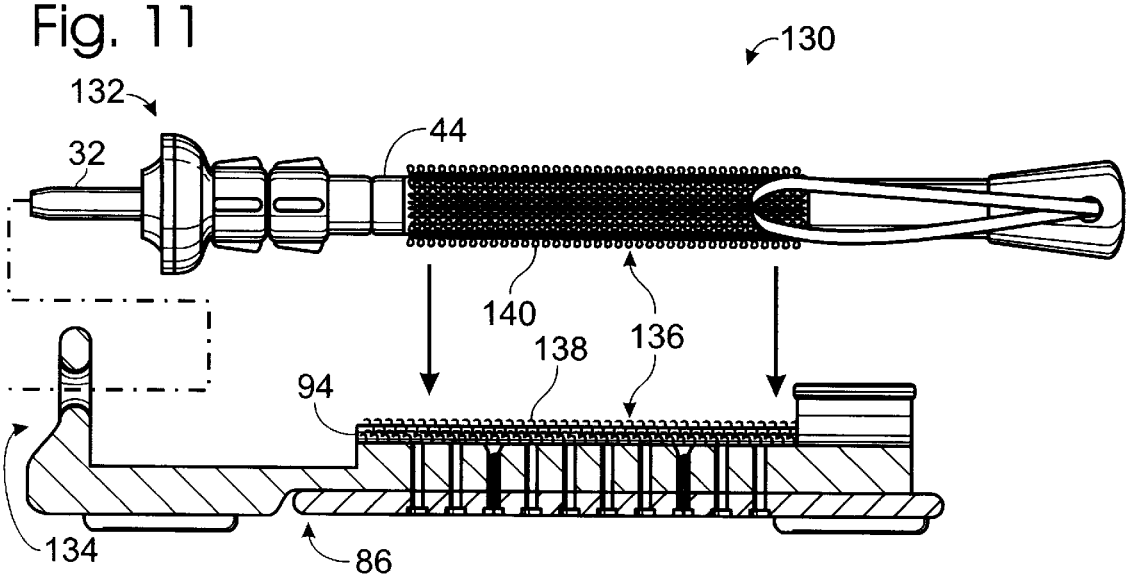
FIG. 11 is a side elevation view showing another embodiment of the invented receiver and snowboard pole.

In FIG. 11, another embodiment of the invented snowboard pole system is shown and indicated generally at 130. System 130 includes pole 132 and receiver 134. Unless otherwise indicated, pole 132 and receiver 134 include the same elements and subelements as pole 12 and receiver 14 shown in FIGS. 1–8. Unlike the prior embodiments, system 130 includes a hook and loop closure mechanism 136 that further secures pole 132 on receiver 134. As shown, mechanism 136 includes a first portion 138 that extends along region 94 of support structure 86, and a second portion 140 that extends around segment 44. Preferably, portion 140 extends all the way around segment 44 so that any radial mounting orientation of pole 132 on receiver 134 will engage the corresponding portions 138 and 140 of mechanism 136, and thereby provide an additional support and retaining force on pole 132.

It should be understood that receiver 14 may be adapted to receive and selectively retain collapsed poles of a variety of shapes and sizes. Preferably, the length (end-to-end distance) of collapsed pole 12 does not substantially exceed the similarly measured length of receiver 14. As such, pole 12 does not substantially project above or below receiver 14. When pole 12 has a cross-sectional configuration that is noncircular, region 94 should have a similar configuration to provide a stabilizer for the pole when mounted on the support. Alternatively, receiver 14 may be formed without stabilizing region 94. Additionally, the axis defined between retainers 82 and 84 may diverge from being parallel to the long axis of receiver 14 to accommodate poles with larger baskets. In this case, aperture 90 of retainer 82 would be spaced further away from support structure 86. It should be further understood that receiver 14 could be formed with or without pole-receiving strap 96, with only a single retainer, with a pair of similar retainers, such as two retainers 84, or with a single retainer and the above-described hook and loop fastening mechanism.

Because pole 12 is mounted generally against receiver 14, it may be necessary to resect a portion of basket 24 when it is desirable to use a basket that would not otherwise fit between the pole's mounting position on receiver 14 and support structure 86. Because some baskets are formed from a rigid perimeter that is secured to the pole by flexible straps, intermediate sized baskets may flex or deform to fit within the spacing requirements of receiver 14. It should be understood, however, that it is within the scope of the present invention that all known baskets may be adapted for use with the present invention, however, larger baskets may require a portion of the basket to be removed or reshaped to enable the collapsed pole to be mounted on receiver 14 and retained proximate the user's limb portion.

To use the invented snowboard pole system, the receiver is first sized to fit the desired limb portion. When selecting the desired length, the receiver is preferably as long as possible without causing the user's flexibility of movement to be restricted by any portion of the invented system, including the receiver, strap structure, or collapsed pole. Another factor when selecting the desired length of the receiver is the position of the strap structure about the selected limb portion. For example, when mounting the receiver on the user's lower leg, as shown in FIG. 1, it is desirable to have the upper strap extend just below the user's knee and the lower strap to extend around the user's boot. This position provides increased stability for the system and prevents the system from sliding upward or downward during use. When a nonadjustable receiver is to be used, it should be understood that it would be available in a variety of lengths so that the user could select the appropriate length for his or her intended use.

Once the receiver is sized for the particular user, it is secured against the user's limb or other body portion by the system's strap structure. When the strap structure is adjustable, some or all of its individual segments may need to be initially adjusted to size the structure to securely retain the receiver on the user's limb without being too tight.

To mount the pole on the receiver, the user first collapses the pole to its collapsed, shortest position by manipulating the pole's lock mechanism or mechanisms. When a lock mechanism with the above-described cam structure is used, this is accomplished by rotating the adjacent segments of the poles to position the lock mechanism in an unlocked or unbiased position, collapsing the segments to their shortest collective length, and then rotating the segments in the opposite direction to lock the mechanism and retain the segments in the collapsed position. Once adjusted to be in its collapsed position, the tip of the pole is inserted within the aperture or cavity of retainer 82 or 132, and then the upper portion of the pole is snap-fit into retainer 84. In this position, the retainers collectively should be able to retain the pole on the receiver under almost all situations, including when the user crashes and when the user lands (or attempts to land) from a jump. When increased support is desired, or when the user is not going to use the pole for a while, the pole-retaining strap may be secured about the pole to prevent unintentional removal of the pole under any conditions.

It should be understood that the above process will most commonly be repeated to mount another snowboard pole system on another selected limb portion, such as the corresponding other leg or arm portion.

From a sitting position in the snow with the user's feet mounted on the board, the user can now grab the pole or poles, urge the upper portion away from retainer 84 to release the snap-fit and then remove the tip from the other retainer. Once removed, the collapsed pole can be extended to a desired extended position. Typically, this is between two and one half and four feet, and it is intended that poles may have maximum extended lengths within this range in one or two inch increments. The extended poles can then be used to provide the necessary leverage for the user to get to a standing position on the board without having to undergo the tiring or inconvenient processes previously required. It should be understood that the pole may provide sufficient leverage for the user in its collapsed or an intermediate position.

Once standing, with the poles in their extended position, they can be used to stabilize the user on the board and stop any movement caused by the force of the standing process.

This is particularly appropriate for beginning snowboarders who require extra stability and support until they become comfortable steering, stopping and maneuvering the snowboard. The poles can also be used to propel the user to a desired position, regardless of whether the position is far away from the user or uphill from the user's current position. Once positioned at the top of a run, the poles can be quickly shortened to their collapsed positions and remounted on their respective receivers. Then the user simply tips forward or slightly hops forward onto the downslope of the run, where the user snowboards down the run. Beginning users may wish to keep the poles in an extended position to provide stability and support as they learn to snowboard.

At the bottom of the run, the poles can be removed from the receiver, extended and then used to propel the user to the lift or tow line. Even if the user has to stop and slowly move forward in the line (for example if there are many skiers and snowboarders waiting in line), the poles can be used to propel, stabilize and stop the user. Any snowboarder should understand from the above that the invented snowboard pole system significantly reduces the time and hassle required to get from the bottom of a run, to and through the lift line and back to the start of a selected run. Instead of having to stop at the bottom of the run, sit down, remove at least one foot from its bindings, awkwardly move to and through the lift line, be carried up the hill with only one foot strapped to the board (thereby putting considerable strain on the ankle of that foot), get off the lift and try to balance or even steer with only one foot secured to the board, move to a desired position, sit down, refasten the removed foot, etc., the user can maintain both feet within their bindings at all times and therefore can steer and maneuver the board at all times. Furthermore, the board can be propelled and stopped without requiring removal of one or both feet from their bindings.

While the invention has been disclosed in its preferred form, it is to be understood that the specific embodiment thereof as disclosed and illustrated herein is not to be considered in a limiting sense as numerous variations are possible and that no single feature, function or property of the preferred embodiment is essential. The invention is to be defined by the scope of the issued claims.

I claim:

1. A snowboard pole system, comprising the combination of:

a collapsible snowboard pole having a user-grippable handle region, a plurality of telescoping segments, and a snow-engaging region, wherein the pole is selectively adjustable between a collapsed position and one or more extended positions longer than the collapsed position, and further wherein the pole includes at least one lock mechanism adapted to selectively retain adjacent ones of the plurality of telescoping segments in a selected position with respect to each other; and a receiver including strap structure with upper and lower straps adapted to mount the receiver on a user's limb, said receiver further including an upper retainer and a lower retainer, and an elongate, selectively adjustable support structure which includes a main member and at least a first upper member adjustably connected to the main member, wherein the lower strap is attached to the main member, the upper strap is attached to the first upper member, the lower retainer is attached to a lower end portion of the adjustable support structure, and the upper retainer is attached to an upper end portion of the adjustable support structure, wherein the upper and lower retainers are maintained in spaced-apart, axially aligned configurations by the elongate support structure, wherein the upper and lower retainers are respectively adapted to selectively receive and retain generally parallel to the limb spaced-apart upper and lower regions of the pole when the pole is in its collapsed position, wherein the support structure defines a first distance between the upper and lower retainers and a second distance between the upper and lower straps, and wherein the support structure permits adjustment of the second distance independent of the first distance.

2. The system of claim 1, wherein at least one of the upper and lower retainers is adjustably mounted on the support structure to permit adjustment of the first distance.

3. The system of claim 1, wherein at least one of the upper and lower retainers is adjustably mounted on the support structure to permit adjustment of the first distance independent of the second distance.

4. The system of claim 1, wherein the upper retainer is mounted on the first upper member.

5. The system of claim 1, wherein the upper retainer is mounted on the main member.

6. The system of claim 1, wherein the lower retainer projects generally transverse to the elongate support structure and defines a closed boundary with an aperture through which a portion of the snow-engaging region extends when the pole is in its collapsed position and mounted on the receiver.

7. The system of claim 1, wherein the snow-engaging region includes a basket having an upper surface and a lower surface, and further wherein when the pole is mounted on the receiver, the lower retainer is adapted to engage and support the lower surface of the basket.

8. The system of claim 7, wherein when the pole is mounted on the receiver, the upper surface of the basket is free from direct engagement with the lower retainer.

9. The system of claim 1, wherein the upper and lower retainers are adapted to permit removal of the snowboard pole from the receiver in a direction generally parallel to the support structure.

10. The system of claim 1, wherein the receiver further includes a pole-retaining strap mounted on the receiver at a first position and adapted to secure the pole on the receiver by defining with the receiver a closed boundary around the pole in a plane transverse to the long axis of the pole, wherein the strap extends from the first position around a portion of the pole and returns to the receiver at a second position, where it is releasably secured to the receiver.

11. The system of claim 1, wherein the pole has a cross-sectional configuration with a radius of curvature, and further wherein at least a portion of the support structure has a concave cross-sectional configuration with a radius of curvature that generally corresponds with the radius of curvature of the collapsed pole and which is positioned on the receiver to support the pole when retained on the receiver.

12. The system of claim 1, wherein at least one of the upper and lower retainers includes a deformable clip.

13. The system of claim 1, wherein the pole includes a tip and the lower retainer includes a cup-shaped member having an opening through which the tip extends when the pole is mounted on the support structure.

* * * * *